US007159247B2

(12) United States Patent
Kim

(10) Patent No.: US 7,159,247 B2
(45) Date of Patent: Jan. 9, 2007

(54) CAP HAVING A FLEXIBLE HEADBAND

(75) Inventor: Il Dong Kim, Seoul (KR)

(73) Assignee: Dada Corp., Seoul (KR)

( * ) Notice: Subject to any disclaimer, the term of this patent is extended or adjusted under 35 U.S.C. 154(b) by 183 days.

(21) Appl. No.: 10/673,517

(22) Filed: Sep. 30, 2003

(65) Prior Publication Data

US 2005/0066420 A1 Mar. 31, 2005

(51) Int. Cl.
*A42B 1/04* (2006.01)
*A42B 1/22* (2006.01)

(52) U.S. Cl. ..... 2/181; 2/195.3

(58) Field of Classification Search ..... 2/195.1, 2/181, 184, 200.1, 175.1, 425, 195.2, 195.3
See application file for complete search history.

(56) References Cited

U.S. PATENT DOCUMENTS 5,641,560 A * 6/1997 Schmidt et al. ..... 428/220
5,715,540 A * 2/1998 Cho ..... 2/195.3
6,000,062 A * 12/1999 Trakh ..... 2/171
6,016,572 A * 1/2000 Park ..... 2/195.2
6,067,658 A * 5/2000 Cho ..... 2/181

* cited by examiner

*Primary Examiner*—Peter Nerbun
(74) *Attorney, Agent, or Firm*—Mayer, Brown, Rowe & Maw LLP

(57) ABSTRACT

A headband mainly used for headwear and constructed by properly weaving 100% nylon combustible yarn. Having no polyurethane, the headband is woven to single ply or two-ply without an additional stitched portion, and exhibits good elasticity as a whole through the napped, felt-like structure of the textile. The circumferential stretch direction of the headband also provides excellent sweat absorption capability. With this construction a wide range of automatic size adjustment is obtained without imposing undue elastic pressure on the wearer such that the cap and headband are comfortable for extended periods of wear.

14 Claims, 2 Drawing Sheets

CAP HAVING A FLEXIBLE HEADBAND

BACKGROUND OF THE INVENTION

1. Field of the Invention

The present invention is related to the field of headwear and, more particularly, to a cap and a headband that demonstrate suitable elasticity to remain comfortable for extended use while naturally accommodating a range of head sizes.

2. Description of the Related Art

Caps of the baseball-style type generally include a drown main body, a visor portion that is secured to the forward edge of the crown and extends outwardly therefrom, a headband or sweatband attached to the lower part of the inside of the crown, and a size controller attached to an underside of the rear of the cap.

Alternatively, cap headbands have been constructed that include an elastic band made of fabric which includes spandex yarn, giving the headband size flexibility while eliminating the size controller. A representative example of such a cap is disclosed in U.S. Pat. No. 6,016,572, in which the cap is composed of the crown part which is woven with at least two or more panels of inelastic fabric, with elastic material interlocking several panels that make up the crown part. Attached to the inner edge of the crown part is an elastic headband which includes flexible spandex yarn to fit the wearer's head such that no separate size controller is required. It has been found, however, that caps relying on spandex headbands for sizing exert pressure against the wearer's head due to their high elasticity which can become uncomfortable after the cap is worn for an extended period of time.

Accordingly, a need exists for an improved headband that provides automatic cap size adjustment as well as increased wearer comfort through the prevention of undue pressure on the wearer's head so as to remain comfortable when worn over extended time periods.

SUMMARY OF THE INVENTION

In view of the foregoing, one object of the present invention is to provide headwear with a headband that provides size adjustment but which does not exert undue pressure on the head when worn.

Another object of the present invention is to provide a headband made without polyurethane and being stretchable due to the structure of the fabric.

A further object of the present invention is to provide a headband that is produced by weaving 100% nylon combustible yarn with a single or two-ply construction.

Yet another object of the present invention is to provide a headband demonstrating excellent sweat absorbing capability.

A still further object of the present invention is to provide a cap having a headband of sufficient elasticity to provide variable sizing to the cap without the need for a separate size controller.

In accordance with these and other objects, the present invention is directed to a headband mainly used for headwear and constructed by properly weaving 100% nylon combustible yarn, in single or two-ply, without making or needing an additional stitching portion for connection of the headband to headwear. Having no polyurethane, the headband demonstrates elasticity as a whole due to the structure of the fabric, and the circumferential stretch direction of the headband also provides excellent sweat absorption capability. With this construction, a wide range of automatic size adjustment is obtained without imposing undue elastic pressure on the wearer such that the cap and headband are comfortable for extended periods of wear.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3-1 is a side view of the yarn used in weaving the headband according to the present invention, in which the yarn is in an unstretched condition; and FIG. 3-2 is a side view of the yarn used in weaving the headband according to the present invention, in which the yarn is in a stretched condition.

DETAILED DESCRIPTION OF THE PREFERRED EMBODIMENTS

Figure 1:
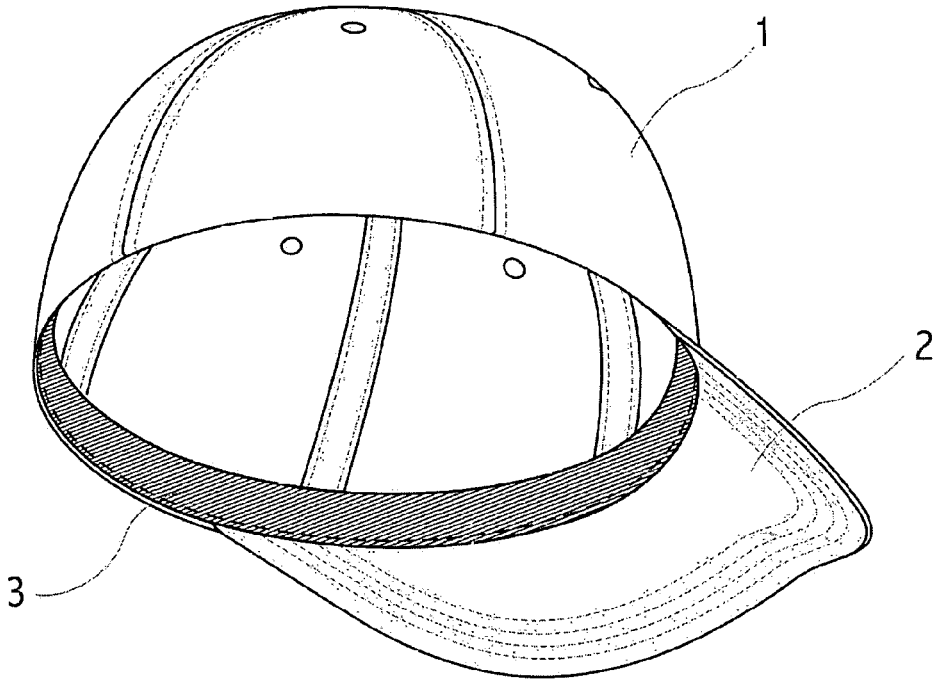
FIG. 1 is a bottom perspective view of a baseball-style cap with a headband according to the present invention.

In describing preferred embodiments of the invention illustrated in the drawings, it is to be understood that these embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The present invention is directed to a headband suitable for use with headwear of various types, but is described herein in connection with a baseball-style cap as shown in FIG. 1. It is understood that the inventive headband may also be used with other types of headwear or even alone.

Figure 2:
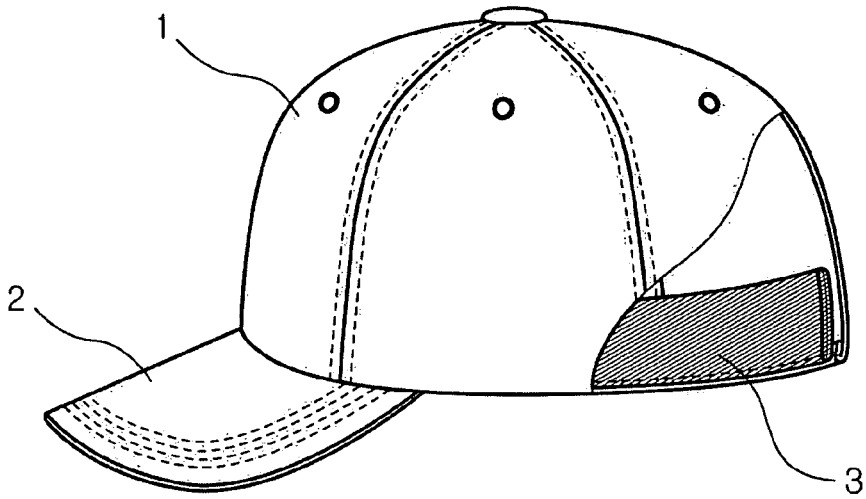
FIG. 2 is a side view of the cap of FIG. 1, with a partial cutaway to show the headband according to the present invention.

According to the embodiment illustrated in FIGS. 1 and 2, the present invention is directed to a baseball-style cap including a crown main body, generally designated by the reference numeral 1, a visor portion, generally designated by the reference numeral 2, and a headband, generally designated by the reference numeral 3. The crown main body 1 is generally made of more than one piece of fabric, having several panels. The visor portion 2 is secured to the forward edge of the crown main body 1, and the headband 3 is secured to the lower peripheral edge of the interior of the crown main body 1.

One or more of the panels composing the crown main body 1 is made of fabric or hand-knitted textile that may or may not include spandex or other elastic yarn. The headband contains no polyurethane and, according to one preferred embodiment is made of a single ply, without a stitched portion for attachment to the crown main body, by weaving it with combustible yarn that is 100% nylon. The headband may also be made to be two-ply when desired.

Figures 1, 3:
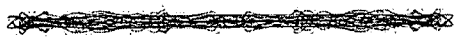
Figures 2, 3:
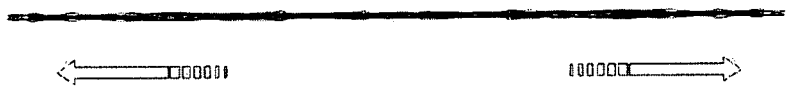

The headband 3 has excellent elasticity in the direction of the circumference thereof, which extends around the lower edge of the crown main body 1. FIG. 3-1 depicts the yarn used in weaving the headband, when in an unstretched condition, while FIG. 3-2 illustrates the yarn after the flexible headband has been expanded. The yarn used for the flexible headband is enabled to retain a flat shape, without twisting in the middle, by being passed through a bulking process in which it is processed to be shrunk through a low temperature, short-time combustion method, followed by drying and heat treatment after weaving. When so processed, the yarn is napped or "fluffy", having a felt-like structure as shown in FIG. 3-1 which readily allows stretching or extension of the yarn. Thus, as a result of the woolen felt-like structure of the woven textile, the yarn of the headband may be easily expanded in use to fit the particular wearer. The stretched direction, shown by the arrows in FIG. 3-2, is along the circumference of the cap which also prevents sweat from running down the wearer's forehead when the cap is worn. Finally, the woolen felt-like structure gives the headband a "spongy" quality, being compressible to provide excellent cushioning to the wearer.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the headband may be incorporated into hats, caps and visors of other styles, or may be used alone. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball-style cap with a flexible headband comprising:

a crown main body having a plurality of panels;

a visor portion secured to a forward portion of said peripheral edge of said crown main body and extending outwardly therefrom;

a headband sewn along said lower peripheral edge of said crown main body, said headband having no polyurethane and being woven with 100% nylon combustible yarn, wherein said yarn is passed through a bulking process and processed to be shrunk through low temperature, short-term combustion method, drying and heat treatment after weaving such that said yarn has a napped or fluffy structure.

2. The cap as set forth in claim 1, wherein said headband is woven as a single textile portion with no additional stitching portion for connection to said crown main body.

3. The cap as set forth in claim 2, wherein said yarn of the headband has a napped structure without twisting in a middle of said headband, such that said headband is stretchable due to said structure.

4. The cap as set forth in claim 3, wherein the headband is single ply.

5. The cap as set forth in claim 3, wherein the headband is two-ply.

6. The cap as set forth in claim 1, wherein said panels of said crown main body are made of knitted material containing spandex.

7. The cap as set forth in claim 1, wherein said panels of said crown main body are made of knitted material without spandex.

8. The cap as set forth in claim 1, wherein said panels of said crown main body are made of fabric material containing spandex.

9. The cap as set forth in claim 3, wherein said panels of said crown main body are made of knitted material containing spandex.

10. The cap as set forth in claim 3, wherein said panels of said crown main body are made of knitted material without spandex.

11. The cap as set forth in claim 3, wherein said panels of said crown main body are made of fabric material containing spandex.

12. A stretchable headband for headwear, said headband having no polyurethane and being woven with 100% nylon combustible yarn as a single textile portion without any additional stitching portion, wherein said yarn is passed through a bulking process and processed to be shrunk through low temperature, short-term combustion method, drying and heat treatment after weaving such that said yarn has a file-shape.

13. The headband as set forth in claim 12, wherein the headband is single ply.

14. The headband as set forth in claim 12, wherein the headband is two-ply.

* * * * *